US008151467B2

(12) United States Patent
Wllem et al.

(10) Patent No.: US 8,151,467 B2
(45) Date of Patent: Apr. 10, 2012

(54) CUTTER MEMBER FOR A ROTARY SHAVER, METHOD FOR MAKING SUCH A MEMBER AND ROTARY SHAVER PROVIDED THEREWITH

(75) Inventors: Minkes Wllem, Drachten (NL); Bastiaan Johannes De Wit, Drachten (NL); Albert Jan Aitink, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 518 days.

(21) Appl. No.: 11/718,381

(22) PCT Filed: Oct. 28, 2005

(86) PCT No.: PCT/IB2005/053522

§ 371 (c)(1),
(2), (4) Date: May 1, 2007

(87) PCT Pub. No.: WO2006/048799

PCT Pub. Date: May 11, 2006

(65) Prior Publication Data

US 2009/0025227 A1 Jan. 29, 2009

(30) Foreign Application Priority Data

Nov. 1, 2004 (EP) ..... 04105436

(51) Int. Cl.
*B26B 19/14* (2006.01)

(52) U.S. Cl. ..... 30/43.6; 30/346.51

(58) Field of Classification Search ..... 30/43.6, 30/346.51; D28/50

See application file for complete search history.

(56) References Cited

U.S. PATENT DOCUMENTS

| | | | | | |
|---|---|---|---|---|---|
| 3,125,808 | A | * | 3/1964 | Starre | 30/43.6 |
| 3,962,784 | A | * | 6/1976 | Tietjens | 30/43.6 |
| 4,192,065 | A | * | 3/1980 | Tietjens | 30/43.6 |
| 4,222,168 | A | * | 9/1980 | Boiten et al. | 30/43.6 |
| 4,227,301 | A | * | 10/1980 | Van Hemmen et al. | 30/43.6 |
| 4,240,199 | A | * | 12/1980 | Boiten et al. | 30/43.6 |
| 4,258,470 | A | * | 3/1981 | Boiten et al. | 30/43.6 |
| D294,981 | S | * | 3/1988 | Izumi | D28/50 |
| 5,390,416 | A | * | 2/1995 | Uchiyama et al. | 30/43.6 |
| 5,408,749 | A | * | 4/1995 | Momose | 30/43.6 |
| D365,420 | S | * | 12/1995 | Momose | D28/50 |
| D405,231 | S | * | 2/1999 | Nakano | D28/50 |
| D405,921 | S | * | 2/1999 | Nakano | D28/50 |
| 6,502,309 | B2 | * | 1/2003 | De Vries et al. | 30/34.2 |
| 6,581,289 | B2 | * | 6/2003 | Nakano | 30/43.6 |
| 6,823,590 | B2 | * | 11/2004 | Uchiyama et al. | 30/43.6 |

(Continued)

FOREIGN PATENT DOCUMENTS

EP 0019954 A1 12/1980

(Continued)

*Primary Examiner* — Kenneth E. Peterson
*Assistant Examiner* — Jennifer Swinney

(57) ABSTRACT

A cutter member for a rotary shaver includes a number of cutters arranged in at least two rings around a central axis, and a number of upwardly bent arms connecting the cutters to the central base. The rings are formed by bending some of the arms more outward and/or inward than others. Further, the cutter member may be made by consecutively cutting a blank of sheet material so as to have a number of arms with cutters and by bending some of the arms more outward and/or inward than others, so as to arrange the cutters in the at least two rings.

11 Claims, 3 Drawing Sheets

U.S. PATENT DOCUMENTS

| | | | | |
|---|---|---|---|---|
| 6,881,923 | B2 * | 4/2005 | Battaglia | 219/121.67 |
| 6,952,879 | B2 * | 10/2005 | Okabe | 30/346.51 |
| 2002/0014011 | A1 * | 2/2002 | De Vries et al. | 30/43.6 |
| 2005/0138813 | A1 * | 6/2005 | Steele et al. | 30/35 |

FOREIGN PATENT DOCUMENTS

| | | | |
|---|---|---|---|
| EP | 0566292 | A1 | 10/1993 |
| EP | 1354676 | A1 * | 10/2003 |
| WO | WO 2004012914 | A1 * | 2/2004 |

* cited by examiner

CUTTER MEMBER FOR A ROTARY SHAVER, METHOD FOR MAKING SUCH A MEMBER AND ROTARY SHAVER PROVIDED THEREWITH

The invention relates to a cutter member for a rotary shaver, comprising a series of cutters, arranged in at least two rings around a central axis of the cutter member, and a number of upwardly bent arms, connecting said cutters to a central base.

Such a cutter member is known from U.S. Pat. No. 5,390,416. The cutters, arms and central base of this known member are integrally cut from a single piece of material (hereinafter called a blank). In a first embodiment, the arms are of identical shape and extend radial from the central base. Each arm ends in a U-shaped portion, which is bent upward and twisted over about 90°, so that the legs of all U-shaped end portions form two concentric rings of cutters. In a second embodiment, the arms are of different radial length and each provided with a single cutter, bent upward. Thanks to the different arm lengths, the cutters extend in multiple concentric rings.

An advantage of this known cutter member is that, as the arms and cutters can be cut and bend from a single sheet of material, no large numbers of components need to be handled and assembled, saving time, effort and manufacturing costs. Moreover, cutting and bending can be done rather accurately, allowing the cutters to be positioned with high precision.

A disadvantage of this known cutter member is that the number of cutters in the respective concentric rings may be restricted due to limited material available in the starting blank.

It is an object of the invention to provide a cutter member of the above-described type, in which the disadvantage of the known cutter member is avoided, while maintaining the advantage thereof. To that end a cutter member according to the invention.

By bending some of the arms more outward than others, the cutters connected to the arms can be positioned in a desired number of preferably concentric rings. In addition or alternatively, some of the arms can be bend more inward than others. In this description the term 'outward' means 'away from a central axis of the cutter member', as opposed to 'inward', which means 'towards said central axis'. By bending the arms appropriately, freedom of design is obtained to route the arms such that the available starting material (blank) is optimally used. Moreover, by varying the bending direction, the number of rings and the number of cutters per ring can be readily changed.

The arms can for instance be alternately bent outward and/or inward so that two or more rings are formed, each with an equal number of cutters. Alternatively, the arms may be bent in such way that the number of cutters differs per ring. In the latter case, the number of cutters of the outer ring or rings is preferably larger than that of the inner ring or rings. This may increase the shaving efficiency, as the shaving speed, measured in tangential direction of the rings, increases as the radius to the central axis (which in use will substantially coincide with a rotation axis of the member) increases. Hence, by providing the outer ring or rings with the most cutters, more hairs can be cut at maximum speed.

In further elaboration, at least some of the arms may be equipped with more than one cutter. After appropriate bending of the arm, these multiple cutters of a single arm may take part in two or more rings. Such design may result in an even more efficient use of available starting material.

According to a further preferred embodiment, the arms, or sections thereof, may be bent outward or inward around differently orientated bending axes.

Depending on the shape of the arms, the arms may be bent in different directions. Alternatively, depending on a desired bending direction, the arms may be shaped differently. Hence, two design parameters are available with which for instance the use of available material can be optimized. For example, by choosing the bending directions appropriately, neighboring arms and cutters may be designed to be of complementary shape, so that when cutting these arms and cutters from a starting blank, little material will be wasted.

Also, with the orientation of the bending axes, the orientation of the cutters can be influenced, for example from a substantially upright position to a more slanted position, giving rise to different shaving properties.

The invention furthermore relates to a rotary shaver provided with a cutter member such that the cutter member can be readily cut and bent from a single blank. The cutting and bending of the arms allows for precise positioning of the cutters, without the need for complex, time consuming and costly assembly operations, which moreover may jeopardize the accuracy through a stack up of manufacturing and assembly tolerances. Because the arms can be bent in various directions, the number of cutter rings and the number of cutters per ring can be readily varied.

To explain the invention, exemplary embodiments thereof will now be described with reference to the accompanying drawings, wherein.

In this description, identical or corresponding parts have identical or corresponding reference numerals.

Figure 1:
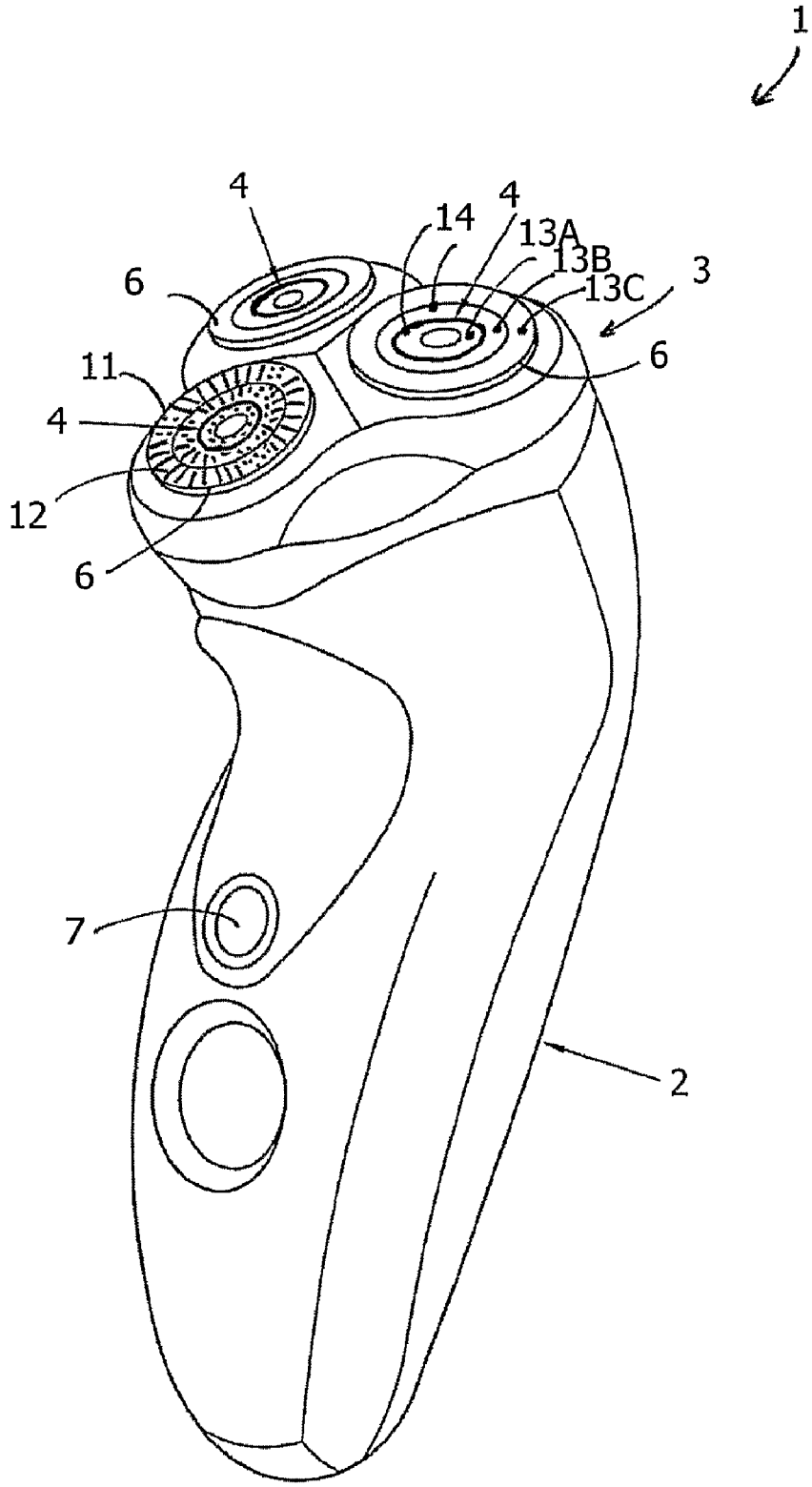
FIG. 1 shows in perspective view a rotary shaver according to the invention, provided with three shaving heads, having concentric annular shaving sections.

FIG. 1 shows a typical example of a rotary shaver 1, comprising a housing 2, provided with a shaver head holder 3, which includes three shaver heads 4. Each shaver head 4 comprises a cap 6, which in use is brought into contact with a user's skin, and a cutter assembly 10, which is rotatably mounted in the shaver head holder 3, below the cap 6, and in use is driven by a motor and suitable transmission means (not shown), accommodated in the housing 2. The housing 2 may further accommodate a power supply (not shown) and a power switch 7.

Each cap 6 is provided with a number of hair entry apertures 11, 12 and two annular grooves 14 (or ribs), which are concentrically arranged around a central axis of the cap and divide said cap 6 into three concentric shaving sections 13A-C. These sections 13A-C form, at their bottom side, between the grooves 14, tracks in which cutters of the abovementioned cutter assembly 10 can rotate, thereby co-operating with the edges of said apertures 11, 12 to cut off any hairs or stubs entering said apertures 11, 12. The grooves or ribs 14 have a stiffening effect on the cap 6. Consequently, the wall thickness of the cap 6 can be reduced, allowing a closer shave. Alternatively the number of hair-entry apertures 11, 12 can be increased, allowing the hairs to enter the cap 6 more readily and increasing the number of edges with which the cutters can co-operate to severe entering hairs.

As furthermore shown in FIG. 1, the hair-entry apertures can be of different design, for instance round 11 and slit-shaped 12. The round apertures 11 are in the given example concentrated in the center of the cap 6, where the cutting speed in use will be lowest. These apertures 11 are generally believed to be more efficient for cutting stubs, since thanks to their limited size, the wall thickness of the cap 6 may be locally reduced, thereby allowing the stubs to be shaved very close to the skin. The slits 12 on the other hand, are generally believed to be good in trapping and re-orienting longer hairs, and are therefore in the present embodiment located more towards the circumferential edge of the cap 6, where in use the cutting speed will be highest. Of course, in alternative embodiments, the shapes, combinations and/or distribution of the apertures 11, 12 may be different. Also, the cap 6 may be provided with more or less annular sections 13.

Figure 2:
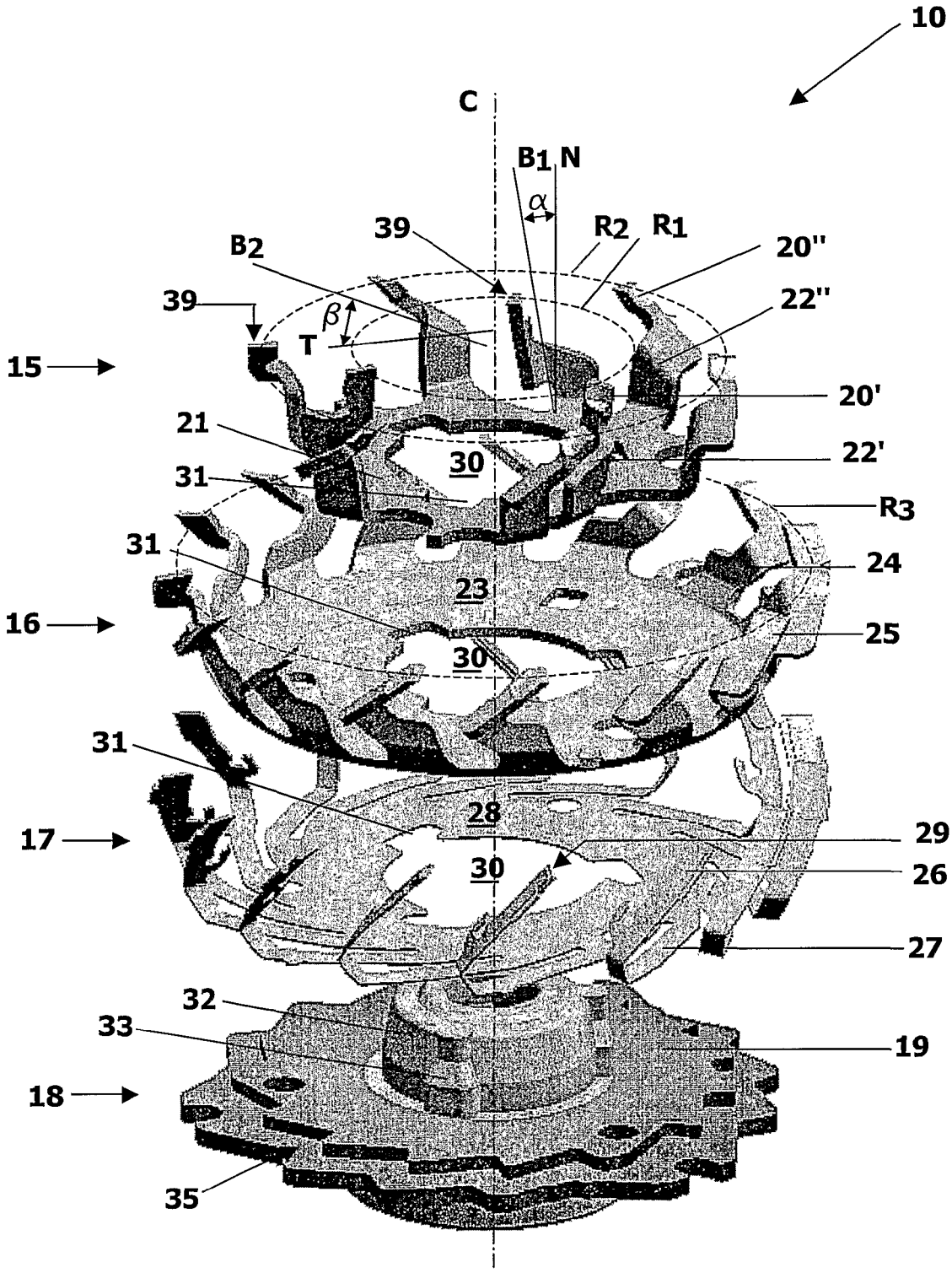
FIG. 2 shows in exploded view a cutter assembly for a shaver head of FIG. 1, comprising a cutter member according to the invention.
Figure 3:
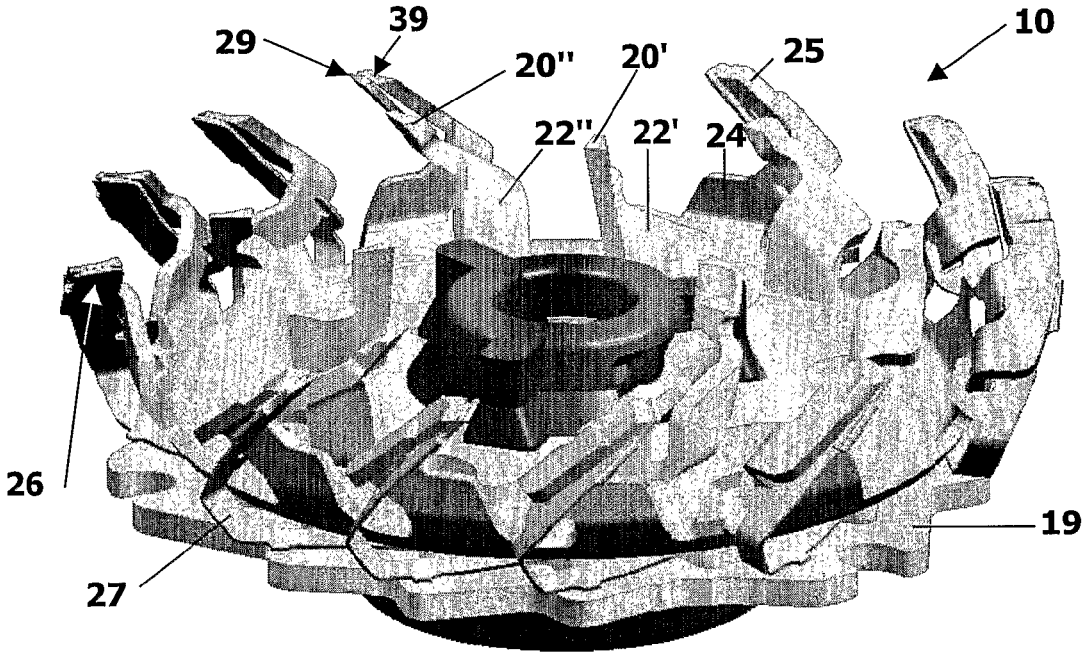
FIG. 3 shows the cutter assembly of FIG. 2, in assembled condition.

The cutter assembly 10 will now be described in more detail with reference to FIGS. 2 and 3, showing an example of such a cutter assembly 10 in exploded view and assembled view respectively. The assembly 10 comprises (see FIG. 2) a first cutting member 15, a second cutting member 16, a hair pulling member 17 and a coupling member 18 provided with a cover plate 19.

The first cutting member 15 comprises in the given example a total of nine cutters 20', 20" which are integrally connected to a central base 21 via a corresponding number of upwardly bent arms 22', 22". The cutters are arranged in two rings around a central axis C, in particular an inner ring $R_1$ containing in the present case three inner cutters 20' and an outer ring $R_2$ containing six outer cutters 20". To that end, three arms 22' have an end portion bent inward, around a first bending axis $B_1$, whereas the remaining six arms 22" have an end portion bent outward, around a second bending axis $B_2$. Of course, the abovementioned total number of cutters 20 and/or arms 22 can be varied, as well as the number of cutters 20', 20" per ring $R_{1,2}$. For instance, both rings $R_{1,2}$ may be provided with an equal number of cutters 20', 20", by alternately bending an arm inward and outward. Therefore, the given numbers should in no way be construed as limiting.

As can be appreciated from FIG. 2, the shape of the arms 22', 22" and the orientation of the first and second bending axes $B_1$,$B_2$ are chosen such, that the cutters 20', 20" have a slightly slanted orientation, with respect to a vertical plane. To that end the first bending axis $B_1$ includes an acute angle $\alpha$ with a normal N of the central base 21. The second bending axis $B_2$ includes an acute angle $\beta$ with a tangent T of the upright portion of the arms 22". It is noted that the illustrated bending directions may be reversed, i.e. arms 22' may be bent outward around the first bending axis $B_1$, whereas the other arms 22" may be bent inward around the second bending axis $B_2$. It is also possible to bent all arms in the same direction, that is outward, respectively inward, thereby bending some arms more outward, respectively inward than others.

Figure 4:
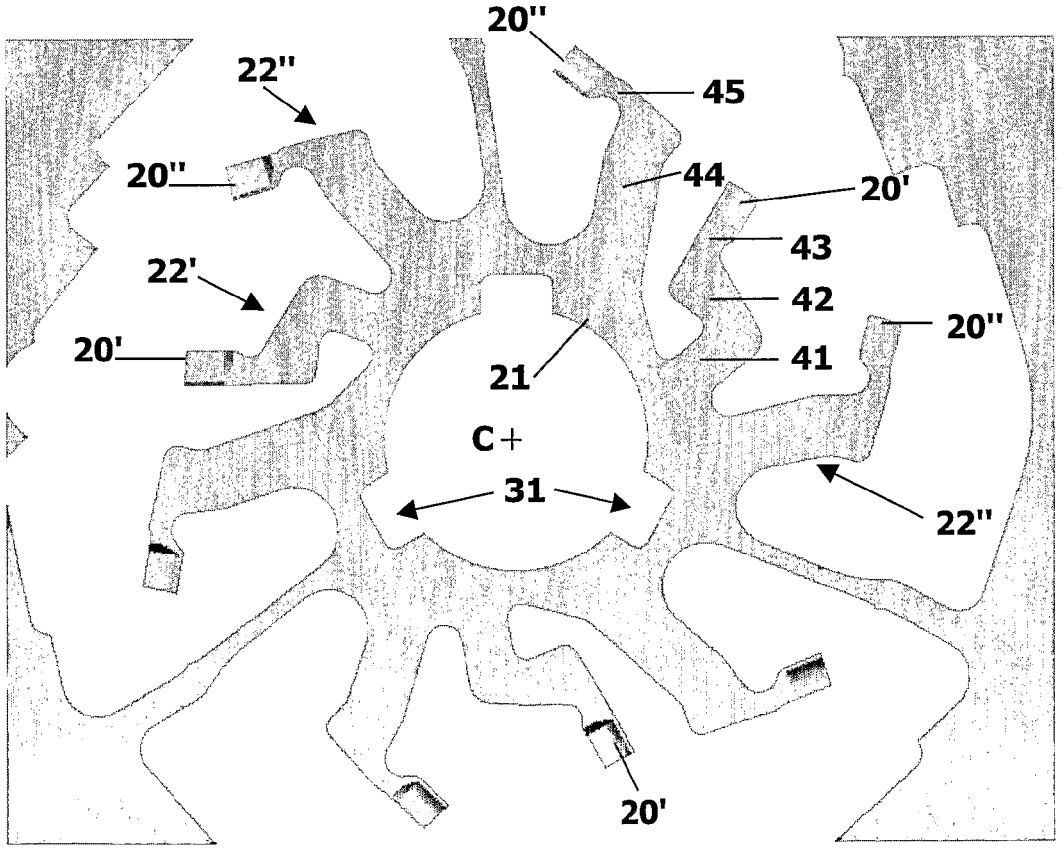
FIG. 4 shows the cutter member of FIG. 2, in unbent condition.

As best seen in FIG. 4, showing the cutter member 15 in unbent condition, the three inwardly bent arms 22' are of substantially Z-shaped configuration, having a first section 41 extending substantially radial from the central base 21, a second section 42 extending substantially tangential thereto and a third section 43 extending substantially radial again.

The outwardly bent arms 22" are of substantial L-shaped configuration, having a first leg 44 extending substantially radial from a central base 21 of the member 15, and a second leg 45 extending substantially tangential thereto. The skilled person will understand, that, depending on the chosen bending directions and bending axes $B_1$, $B_2$, the arms 22', 22" may be shaped differently. Moreover, the arm shapes and bending directions may be varied, so as to make optimum use of the starting material, wasting as little material as possible.

In an alternative embodiment, the first cutting member 15 may be provided with more than two cutter rings $R_{1,2}$. For instance, to form three concentric rings $R_{1,2,3}$ (not shown), a first group of arms 22' may be bent inward similar to or preferably slightly further than the arms shown in FIG. 2, a second group of arms 22" may be bent outward, similar to or preferably slightly further than the arms shown in FIG. 2, and a third group of arms 22'" may be bent straight upward so as to form an intermediate, third ring $R_3$ with cutters 20'".

Additionally or alternatively, in order to increase the number of rings $R_x$ at least some of the arms 22 may be provided with multiple cutters 20, for instance a substantially U-shaped or W-shaped cutter, having two, respectively three cutter legs (not shown).

The second cutting member 16 comprises a single ring $R_3$ of cutters 25, which are integrally connected to a central base 23 via a series of upwardly bent arms 24. An upper end of these arms 24 is bent outward in a similar way as the arms 22" of the first cutting member 15, so that the cutters 25 have a slanted orientation. Moreover, the diameter of the cutter ring $R_3$ is such that the first cutting member 15 can be nested in the second cutting member 16, as seen in FIG. 3, so as to form a composite member having three concentric rings $R_{1-3}$ of cutters 20', 20", 25.

Alternatively, the first and second cutting member 15, 16 can be replaced by a single cutting member, provided with three, preferably concentric rings $R_{1-3}$ obtained by bending some cutter arms more outward and/or inward than others, as described above with reference to the first member 15.

In yet another embodiment, the second cutting member 16 may be provided with multiple rings $R_x$ of cutters 25', 25" (not shown), instead of or in addition to the first cutting member 15. Again, such multiple rings $R_x$ may be realized in a similar way as described before, with reference to the first cutting member 15.

The cutting assembly 10 may furthermore comprise a hair pulling member 17, as shown in FIG. 2, which in the illustrated example can cooperate with the cutters 25 of the second member 16, to cut off hairs closer to the skin. To that end the hair pulling member 17 comprises as many hair pulling elements 26 as the cutting member 16 has cutters 25, wherein each hair pulling element 26 is connected to a central base 28 via a biasing arm 27. In assembled condition, these arms 27 act as springs, biasing the pulling elements 26 against a lower side of the cutters 25, in such way that a free edge 29 of the element 26, viewed in rotation direction, leads with respect to a cutting edge 39 of the respective cutter 25 (as best seen in FIG. 3). This ensures, that in use, when the cutting assembly 10 is rotated, the edge 29 will encounter and engage a hair before the cutting edge of the cutter 25 does. The arm 27 is designed such, that under influence of the force exerted by the hair, the arm 27 will bent downward, thereby pulling the hair further into the aperture, so that the cutter 25 can cut off the hair closer to the skin. For a more detailed description of the hair pulling member and its working principle, reference is made to EP 0 019 954 of applicant, which description is understood to be incorporated herein by reference.

In an alternative embodiments, more hair pulling elements 26', 26" may be provided (not shown), to cooperate with the respective cutters 20', 20" of the first cutting member 15. To that end, a second hair pulling member may be provided (not shown) having a similar configuration as the one shown in FIG. 2, but of smaller diameter, so as to be nestable between the first and second cutting members 15, 16. Such second hair pulling member may be designed to have two rings of hair pulling elements, arranged to co-operate with the two rings of cutters 20', 20" of the first cutting member 15. Alternatively, such second hair pulling member may be provided with one ring of hair pulling members, arranged to co-operate with the outer ring of cutters 20" of the first cutting member 15. In the latter case, a third hair pulling member (not shown) may be provided, to co-operate with said inner ring of cutters 20'. Said third hair pulling member may for instance be designed to be slid around the inner ring $R_1$ from an upper side of the assembly 10 and be subsequently rotated into place, thereby sliding the pulling arms under the respective cutters and locking the member against further rotation.

The cutter assembly 10 of FIG. 2 further comprises a coupling member 18, on which the previously described cutting members 15, 16, hair pulling member 17 and possible further hair pulling members can be mounted. These members 15-17 are thereto each provided with a central opening 30, provided with three recesses 31, in which a central stub 32 of the coupling member 18 can fit with three ribs 33. The ribs 33 and recesses 31 help to align the various components correctly and furthermore, once assembled, prevent relative rotation thereof.

The coupling member 18 furthermore comprises a cover plate 19, provided with a stepped, saw-toothed circumference 35, wherein the upper surface is arranged to support the arms 27 of the hair pulling member 17 in biased condition, and the stepped circumference allows said arm to deform downwards, thereby performing its hair pulling action, and at the same time serves to limit this downward movement.

Thanks to a method according to the invention, it is possible to form a cutter member 15 having cutters 20', 20" extending in multiple rings from a single blank, by simply cutting this blank into a series of integrally connected arms and cutters, and by subsequently bending these arms into a cup shape, wherein some arms are bent more outward and/or inward than others. Moreover, by changing one or more bending directions, the number of rings, as well as the number of cutters per rings can simply be varied. Also, waste of material can be minimized by selecting the design of the arms and/or the bending direction(s) thereof appropriately.

The invention is not in any way limited to the exemplary embodiments presented in the description and drawing. All combinations (of parts) of the embodiments shown and described in this description are explicitly understood to be incorporated in this description and to fall within the scope of the invention, as outlined by the claims. Moreover, many variations are possible within said scope of the invention. For instance, the number of cutter rings may be increased, by increasing the number of nested cutting members, wherein some or each cutting member may have more than one cutter ring. These and many comparable variations are understood to fall within the scope of the invention as outlined by the claims.

The invention claimed is:

1. A cutter member for a rotary shaver, the cutter member comprising:

a plurality of cutters for cutting hair arranged in at least two rings around a central axis of the cutter member, and a number of upwardly bent arms connecting the plurality of cutters to a central base, wherein a first set of the arms connected to the central base is bent more outward of the central axis than a second set of the arms connected to the central base, the plurality of cutters including a first set of cutters connected to the first set of arms, the first set of cutters being arranged along an outer ring of the at least two rings, and the plurality of cutters further including a second set of cutters connected to the second set of arms, the second set of cutters being arranged along an inner ring of the at least two rings, the inner ring being closer to the central axis than the outer ring, wherein the outer ring of the at least two rings comprises more cutters than the inner ring of the at least two rings, and wherein the at least two rings comprises two substantially concentric rings of cutters including the outer ring and the inner ring, wherein the outer ring is formed by bending some of the arms upward and outward and the inner ring is formed by bending remaining of the arms upward and inward.

2. The cutter member according to claim 1, wherein each arm consists of only one cutter.

3. The cutter member according to claim 1, wherein the arms are bent outward or inward around a bending axis extending substantially parallel to, or including a small angle with a normal of the central base.

4. The cutter member according to claim 1, wherein the arms are bent outward or inward around a bending axis extending substantially parallel to a tangent of an upright portion of the arms or including a small angle with the tangent of the upright portion of the arms.

5. The cutter member according to claim 1, wherein at least a number of the arms, in unbent condition, is of substantially L-shaped design, including a first leg extending substantially radial from the central base and a second leg extending substantially tangential to the central base, wherein a free end of said second leg is provided with a cutting edge.

6. The cutter member according to claim 1, wherein at least a number of the cutter arms in unbent condition, is of substantially Z-shaped design, including a first section extending substantially radial from the central base, a second section extending approximately tangential to the central base, and a third section extending substantially radial from the central base, staggered with respect to the first section.

7. The cutter member of claim 1, wherein the first set of the arms are bent inward of a first bending axis, and the second set of the arms are bent outward of a second bending axis, the first bending axis extending substantially parallel to a normal of the central base, or including a first acute angle with the normal of the central base, and the second bending axis extending at a second acute angle with a tangent to the central base.

8. A rotary shaver comprising:

a first cutting member;

a second cutting member; and a hair pulling member;

wherein the first cutting member comprises:

a plurality of cutters for cutting hair arranged in at least two rings around a central axis of the first cutting member, and a number of upwardly bent arms connecting the cutters to a central base, wherein a first set of the arms connected to a central base is bent more outward of the central axis than a second set of the arms connected to the central base, the plurality of cutters including a first set of cutters connected to the first set of arms, the first set of cutters being arranged along an outer ring of the at least two rings, and the plurality of cutters further including a second set of cutters connected to the second set of arms, the second set of cutters being arranged along an inner ring of the at least two rings, the inner ring being closer to the central axis than the outer ring, wherein the outer ring of the at least two rings comprises more cutters than the inner ring of the at least two rings, and wherein the at least two rings comprises two substantially concentric rings of cutters including the outer ring and the inner ring, wherein the outer ring is formed by bending some of the arms upward and outward and the inner ring is formed by bending remaining of the arms upward and inward.

9. The rotary shaver of claim 8, wherein the first set of the arms are bent inward of a first bending axis, and the second set of the arms are bent outward of a second bending axis, the first bending axis extending substantially parallel to a normal of the central base, or including a first acute angle with the normal of the central base, and the second bending axis extending at a second acute angle with a tangent to the central base.

10. A method for making a cutter member for a rotary shaver, comprising the acts of:

cutting a blank of sheet material so as to have a plurality of cutters for cutting hair integrally connected to a central base via a number of arms; and arranging the cutters in at least two rings, above the central base, by bending a first set of the arms connected to the central base more outward of a central axis of the central base than a second set of the arms connected to the central base, wherein the arms are bent in such way that a number of cutters in an outer ring of the at least two rings is larger than a number of cutters in an inner ring of the at least two rings, wherein the plurality of cutters includes a first set of cutters connected to the first set of arms, the first set of cutters being arranged along the outer ring of the at least two rings, and the plurality of cutters further includes a second set of cutters connected to the second set of arms, the second set of cutters being arranged along the inner ring of the at least two rings, the inner ring being closer to the central axis than the outer ring, and wherein the at least two rings comprises two substantially concentric rings of cutters including the outer ring and the inner ring, wherein the outer ring is formed by bending some of the arms upward and outward and the inner ring is formed by bending remaining of the arms upward and inward.

11. The method of claim 10, wherein the first set of the arms are bent inward of a first bending axis, and the second set of the arms are bent outward of a second bending axis, the first bending axis extending substantially parallel to a normal of the central base, or including a first acute angle with the normal of the central base, and the second bending axis extending at a second acute angle with a tangent to the central base.

* * * * *